United States Patent [19]

Geisser

[11] Patent Number: 4,928,822

[45] Date of Patent: May 29, 1990

[54] CABLE END SLEEVE MAGAZINE

[76] Inventor: Carl Geisser, Letzigraben 156, CH-8047 Zürich, Switzerland

[21] Appl. No.: 202,573

[22] Filed: May 25, 1988

Related U.S. Application Data

[62] Division of Ser. No. 26,571, Mar. 17, 1987, Pat. No. 4,765,176.

[30] Foreign Application Priority Data

Mar. 25, 1986 [CH] Switzerland ..... 1215/86

[51] Int. Cl.[5] ..... B65D 73/02

[52] U.S. Cl. ..... 206/330; 29/751; 29/759; 206/329; 206/346; 206/347

[58] Field of Search ..... 29/751, 752, 753, 759; 72/409, 410; 206/328–330, 345–347

[56] References Cited

U.S. PATENT DOCUMENTS

| | | | |
|---|---|---|---|
| 3,048,268 | 8/1962 | Rocchi et al. | 206/329 |
| 3,611,782 | 10/1971 | Eppler | 29/751 X |
| 3,710,610 | 1/1973 | McCaughey | 29/751 X |
| 3,920,121 | 11/1975 | Miller | 206/330 |

*Primary Examiner*—Carl E. Hall

*Attorney, Agent, or Firm*—Browdy and Neimark

[57] ABSTRACT

A tool for mounting cable end sleeves on the ends of cables, the tool having two profiled clamping jaws which can be pressed against a cable end sleeve by means of two pliers arms via a toggle joint. The sleeves to be mounted form an end sleeve magazine together with a carrier which, at the time of the opening of the tool, is transported along by means of a jump feed device.

1 Claim, 3 Drawing Sheets

CABLE END SLEEVE MAGAZINE

This is a division of application Ser. No. 026,571 filed Mar. 17, 1987, now U.S. Pat. No. 4,765,176.

FIELD OF THE INVENTION

The present invention relates to a tool for mounting cable end sleeves onto the ends of cables.

BACKGROUND OF THE INVENTION

A tool for mounting the cable end sleeves on the ends of cables, comprising two jaws movable in respect to each other by pressing together two pliers arms via a toggle joint, a first spring opening the pliers arms and a jump feed device for the incremental advance of a belt-like magazine containing the end sleeves of cables when the pliers arms are actuated, is known from German Published Patent Application DE-AS No. 14 65 151. This is a crimping tool. It comprises two pliers arms linked to a housing. The housing has a shoe against which a cheek plate is pressed when the pliers arms are closed via a toggle joint. An opening spring opens the pliers arms. A slide is movable inside the housing transversely to the direction of closing of the cheek plate. The slide is moved back and forth during the opening and closing of the pliers arms and has an arresting support. A further arresting support is disposed inside the housing. The two arresting supports engage arresting detents of a magazine containing cable end sleeves which is movable within the housing and move this forward in steps, so that one end sleeve of a cable is placed between the cheek plate and the shoe. This tool is of complex construction and therefore expensive to manufacture.

Other tools for the crimping of the cable end sleeves are known from German Laid-Open Application DE-OS No. 15 15 401, U.S. Pat. No. 2,812,676 and German Published Patent Application DE-AS No. 11 12 154. These are even more complicated structures. In DE-OS No. 15 15 401 the magazine containing the cable end sleeves has to be moved forward by a separate lever. In U.S. Pat. No. 2,812,676 an additional lever also must be actuated to clamp the cable end. In DE-AS No. 11 12 154 an additional button must be pressed to open the pliers arms.

SUMMARY OF THE INVENTION

It is an object of the present invention to improve a tool for mounting the cable end sleeves on the ends of cables, comprising two jaws movable in respect to each other by pressing together two pliers arms via a toggle joint, a first spring opening the pliers arms and a jump feed deice for the incremental advance of a belt-like magazine containing the end sleeves of cables when the pliers arms are actuated, in such a way that it can be produced cheaply and is easy to use. This object is attained as described hereinafter.

BRIEF DESCRIPTION OF THE DRAWINGS

An exemplary embodiment of the invention is described by means of the drawing, wherein.

DETAILED DESCRIPTION OF THE INVENTION

Figure 1:
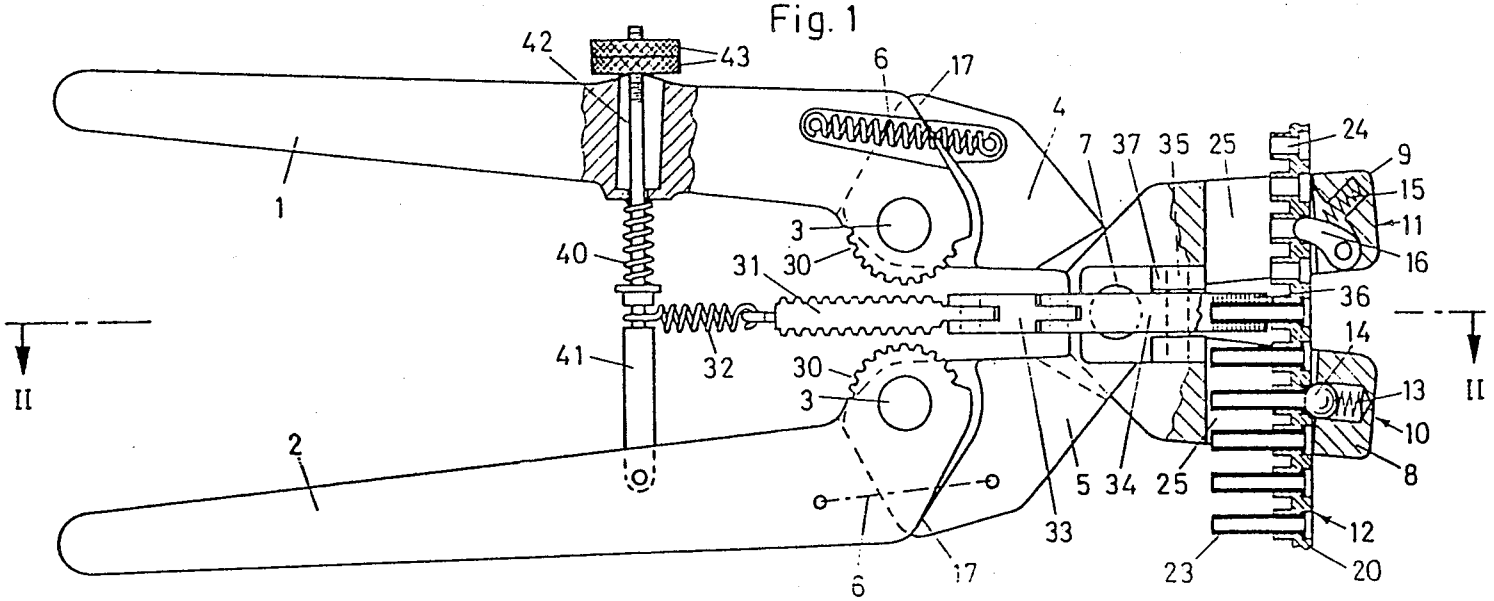
FIG. 1 is a tool for the mounting of cable end sleeves.
Figure 2:
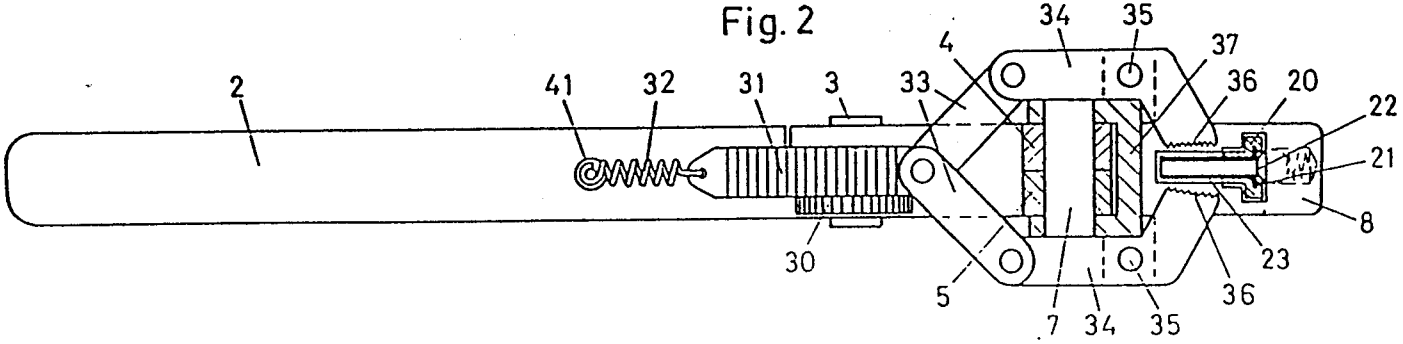
FIG. 2 is a section along the line II—II of FIG. 1.

The crimping tool in accordance with FIGS. 1 and 2 has two pliers arms 1, 2, which are pivotably connected by means of a bolt 3 with respectively one arm of two two-armed levers 4, 5, and which are prestressed in regard to the levers 4, 5, against a detent 17 in the basic position shown in FIG. 1 by means of prestressed springs 6. The levers 4, 5 are pivotable against each other around a bolt 7. On their other arm 8, 9 they have an arresting element 10, 11, respectively, cooperating with an end sleeve magazine 12. The arresting element 10 of the arm 8 consists of a ball 14 prestressed by a spring 13; the arresting element 11 consists of a ratchet 16 prestressed by a further spring 15.

The end sleeve magazine 12 consists of a belt-like carrier 20 of a thermoplastic material having two laterally extending grooves 21 into which engage the conical edges 22 of cable end sleeves 23 aligned at regular intervals along the carrier 20. The arms 8, 9 have openings 25 for the passage of the magazine 12. the ball 14 presses against the conical edge 22 of an end sleeve 23 and assures the exact positioning in the crimping tool of the end sleeve 23 to be mounted. The ratchet 16 engages an empty opening 24 of the magazine 12 and at each opening of the crimping tool pushes the magazine forward one step.

Toothed segments 30 are fastened on the pliers arms 1, 2. When the crimping tool is closed, the segments 30 engage a two-sided gear rack 31 and thus limit the closing movement of the levers 4, 5. In this position the ratchet 16 engages the next opening 24. If the pliers arms 1, 2 are further pressed together, the gear rack 31 is further displace against the force of a spring 32 and, via a toggle joint 33, spreads open one each of the ends of two two-armed levers 34 which are pivotable around a bolt 35 and the other arms of which on their free ends form cooperating profiled clamping jaws 36. When the pliers arms 1, 2 are closed, the clamping jaws 36 crimp the end sleeve 23 between them to an insulated cable end which has been inserted.

The levers 34 are supported by a bolt 35 on a bearing block 37, which is also fixed on the bolt 7.

The crimping tool is pressed into the basic position shown in FIG. 1 by a prestressed spring 40. The spring 40 is supported by a rod 41 linked to the pliers arm 2 and entering a stepped bore 42 of the pliers arm 1. Two knurled nuts 43 are screwed on the free end of the rod 41 and are braced against each other. The length of the step for moving the magazine 12 forward can be set by the nuts 43. The spring 32 is supported on the rod 41.

The spring 40 is weaker than the springs 6, so that when the pliers arms 1, 2 are actuated the latter first pivot, together with the levers 4, 5, around the bolt 7 until the engagement of the toothed segments 30 with the gear rack 31. With the arresting elements 10, 11 at rest, the pliers arms 1, 2 then pivot around the bolts 3 and close the clamping jaws 36.

Figure 3:
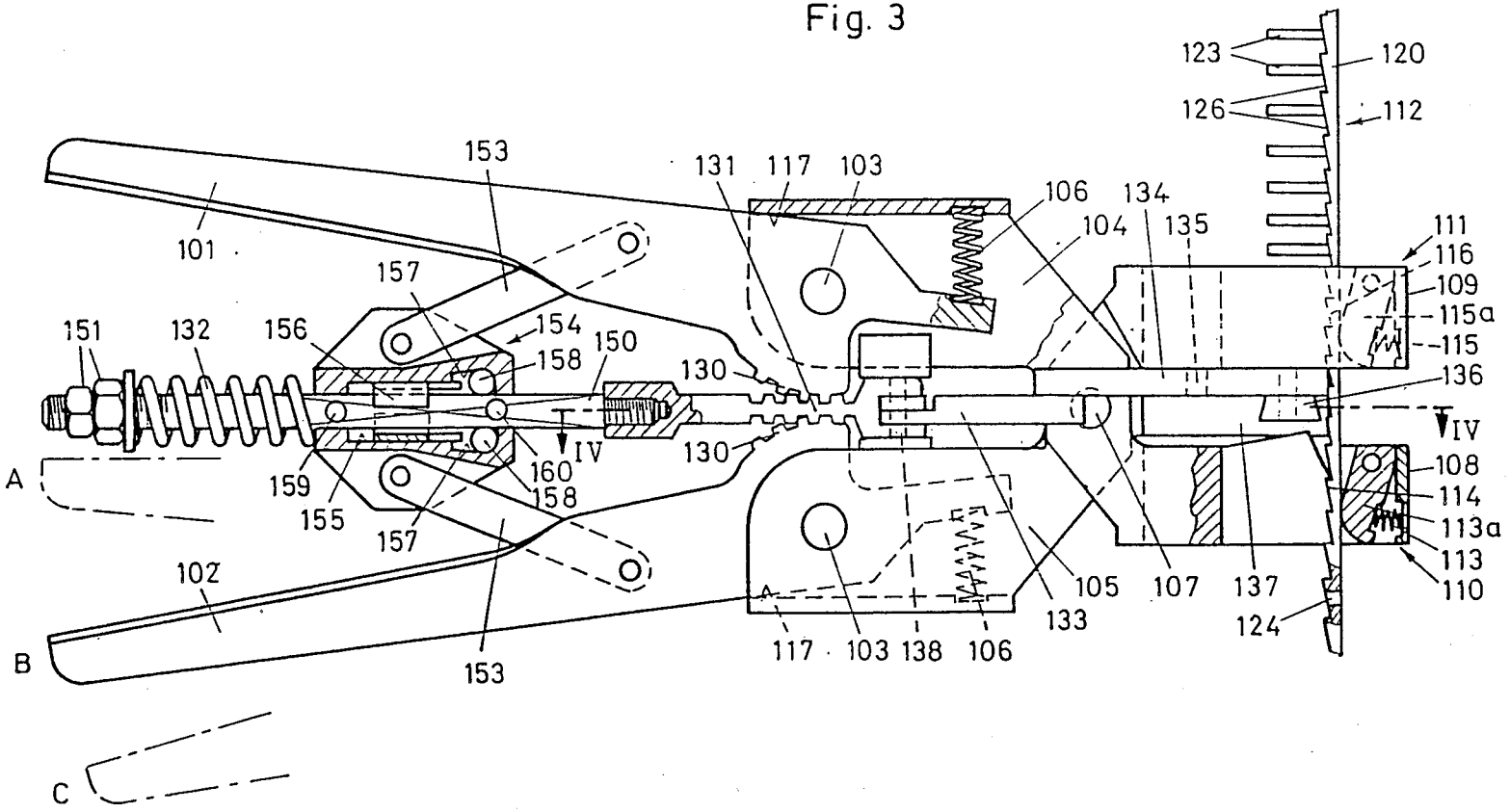
FIG. 3 is a second exemplary embodiment.
Figure 4:
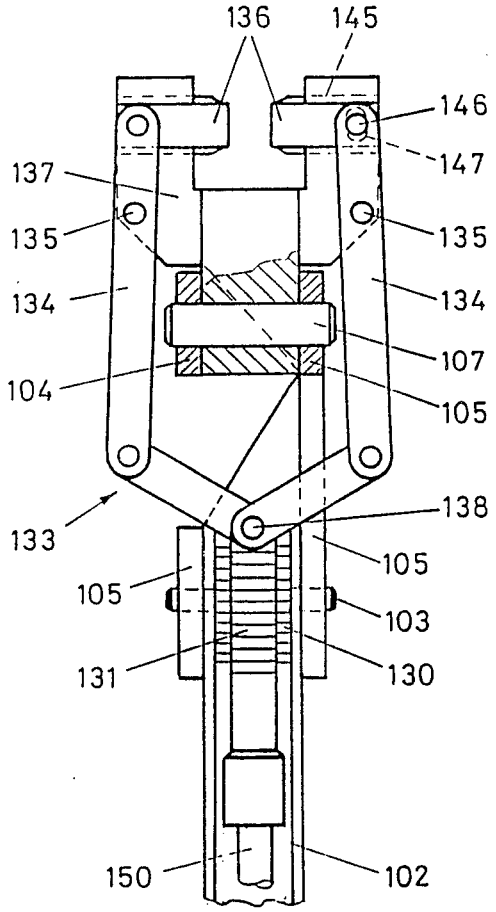
FIG. 4 is a section along the line IV—IV of FIG. 3.

The embodiment according to FIGS. 3 and 4 is constructed similarly to that of FIGS. 1 and 2. For details of construction and operation refer to the exemplary embodiment according to FIGS. 1 and 2 described above. Analogous elements in FIGS. 3 and 4 are provided with reference numerals increased by 100.

The embodiment according to FIGS. 3 and 4 again has two pliers arms 101, 102, linked by bolts 103 to the two-armed levers 104, 105. The prestressed springs 106 which prestressed the pliers arms 101, 102 against a detent 117 in the lever 104, 105 are here in the form of compression springs. The levers 104, 105 are pivotable in the manner of a scissors around the bolt 107 and support the arresting elements 110, 111, which cooperate with the end sleeve magazine 112.

The arresting elements 110, 111 are here constructed differently and consist of sawtooth-like stops 114, 116 on the first arm of the levers 110, 111, which cooperate with the end sleeve magazine 112. The magazine 112 consists of a strip of plastic as a carrier 120 having openings 124 spaced uniformly apart from each other into which cable end sleeves 123 have been inserted. The carrier 120 has sawtooth-like recesses 126, laterally offset in respect to the openings 124 and at the same distance as the openings 124, which the stops 114, 116 engage. In each of the first arms of the levers 104, 105, the carrier 120 is pressed against the stops 114, 116 by a spring 113, 115 and a pressure shoe **113*a*, 115*a***, respectively.

The toothed segments 130 of the pliers arms 101, 102, disposed concentrically to the bolts 103, are at a distance from the gear rack 131 in the fully opened position C indicated by dot-dashed lines. When the arms 101, 102 are pivoted into the position B, they engage the gear rack 131 and thereby limit the pivot angle of the two-armed levers 104, 105. With further compression of the arms 101, 102 into the end position A the leers 104, 105 remain at rest and the gear rack 131 is displaced forward. Its front end supports the knee joint 138 of the toggle joint 133 which, in turn, is disposed transversely to the pivot plane of the pliers arms 101, 102. The levers 134 are actuated via the toggle joint 133 and are pivotable around bolts 135 disposed vertically to the bolt 107. The second arm of the levers 134 actuates the clamping jaws 136, which here are longitudinally slidable in wedge grooves 145 vertically to the longitudinal direction of the carrier 120 and parallel to the bolt 107. A pin 146 extending from the end of the lever 134 engages a slot 147 extending transversely to the direction of the sliding of the clamping jaws 136. The bolts 135 are fastened to the bearing block 137, through which the bolt 107 extends.

The opening spring 132 here is supported on a coaxial square-section rod 150 fastened at the rear end of the gear rack 131 and rests with its one end against nuts 151 at the free end of the rod and with its other against a slide 152 supported on the rod 150. The slide 152 is flexibly connected with the pliers arms 101, 102 via a plunger 153 respectively disposed inclined to the rod axis. The slide 152 includes an arresting element 154 which only permits the opening of the pliers arms 101, 102 after they have completely closed.

The two plungers 153 displace the slide 152 backwards when the pliers arms 101, 102 are pressed together. A sleevelike, longitudinally slit and somewhat radially prestressed slide 156 is slidable under friction in a coaxial opening 155 of the slide 152. The slide 156 has free play in respect to the rod 150. A roller 158 is disposed between two wedge surfaces 157 and the rod 150 respectively. The wedge surfaces 157 are inclined backwards in the direction of the rod. In the front end position of the rollers 158 shown in FIG. 3 they have free play between the wedge surface 157 and the rod 150, so that the pliers arms 101, 102 can be unrestrictedly pressed together. As long as the slide 156 is in the position shown inside the slide 152, however, the pliers arms 101, 102 cannot be opened because then the rollers 158 wedge during the forward movement of the slide 152 on the rod 150 and thereby block the slide 152 in respect to the rod 150.

However, if the pliers arms 101, 102 are completely pressed against each other, a rear stop pin 159 extending transversely through the rod 150 displaces the slide 156 forwardly so that the slide 156 maintains the rollers 158 in the front end position. Thus the arresting element 154 is freed and the pliers arms 101, 102 can be opened. Once they are completely opened, a forward stop pin 160 again displaces the slide 156 into the position shown in FIG. 3. By means of the arresting element 154 it is assured that the cable end sleeves 123 can be crimped completely and correctly onto the cable ends.

Instead of the embodiment shown in FIG. 3, the magazine for the cable end sleeves 112 can have recesses 126 on the front side or on one of the two side surfaces of the carrier 120.

The term "cable end sleeves" indicates bodies with a sleeve-like shaft for crimping on insulated cable ends. End shoes of cables or crimpable plug elements are included in this term as well as sleeves per se.

It is understood that the invention is not restricted to the exemplary embodiments described above and that further improvements or variants thereof are possible within the scope of the invention.

The foregoing description of the specific embodiments will so fully reveal the general nature of the invention that others can, by applying current knowledge, readily modify and/or adapt for various applications such specific embodiments without departing from the generic concept, and therefore such adaptations and modifications are intended to be comprehended within the meaning and range of equivalents of the disclosed embodiments. It is to be understood that the phraseology or terminology employed herein is for the purpose of description and not of limitation.

What is claimed is:

1. A cable end sleeve magazine comprising a unitary disposable, elongated carrier formed of plastic material having a side surface extending in a longitudinal direction of said carrier, said carrier having a plurality of uniformly spaced throughgoing openings in a single row and perpendicular to said side surface, said openings extending through said carrier from said side surface to an opposing surface, and a plurality of saw-tooth shaped recesses transversely displaced from said openings for advancing said carrier in a crimping tool, the recesses having opposed flat and steep flanks, the flat flanks being inclined relative to said side surface, the recesses being uniformly spaced with the same spacing as the openings, and a plurality of cable end sleeves removably inserted and held in said openings, said cable end sleeves projecting from said opposing surfaces of the carrier to be fed to said crimping tool for crimping one at a time, onto a cable end and removing the crimped-on cable end sleeve from the carrier.

* * * * *